United States Patent [19]

Yamasaki et al.

[11] Patent Number: 4,846,903

[45] Date of Patent: Jul. 11, 1989

[54] METHOD FOR PRODUCING A GRAIN ORIENTED ELECTRICAL STEEL SHEET

[75] Inventors: Kouji Yamasaki; Eiji Ikezaki; Yasunori Tano; Hiroshi Nishizaka, all of Kitakyushu, Japan

[73] Assignee: Nippon Steel Corporation, Tokyo, Japan

[21] Appl. No.: 159,448

[22] Filed: Feb. 18, 1988

Related U.S. Application Data

[63] Continuation of Ser. No. 875,267, Jun. 17, 1986, abandoned.

[30] Foreign Application Priority Data

Jun. 17, 1985 [JP] Japan ..... 60-129901

[51] Int. Cl.[4] ..... H01F 1/04

[52] U.S. Cl. ..... 148/111; 148/120; 148/112

[58] Field of Search ..... 148/111, 112, 120

[56] References Cited

U.S. PATENT DOCUMENTS 4,545,828 10/1985 Schoen et al. ..... 148/111
4,554,029 11/1985 Schoen et al. ..... 148/112

FOREIGN PATENT DOCUMENTS 2011146 2/1970 France ..... 148/111

*Primary Examiner*—John P. Sheehan
*Attorney, Agent, or Firm*—Kenyon & Kenyon

[57] ABSTRACT

In the production of a grain-oriented electrical steel sheet, a slab (1) is current-conduction heated, using the slab (1) as a resistor, under a condition of being on or below an apparent current density (I) of from 40 ($A/cm^2$) to 0.5 $P^2+100$ ($A/cm^2$), P being a pressure of electrodes in $kg/cm^2$.

3 Claims, 3 Drawing Sheets

METHOD FOR PRODUCING A GRAIN ORIENTED ELECTRICAL STEEL SHEET

This application is a continuation, of application Ser. No. 875,267, filed Jun. 17, 1986

BACKGROUND OF THE INVENTION

1. Field of the Invention

The present invention relates to a method for producing a grain-oriented electrical steel sheet having improved magnetic properties.

2. Description of the Related Arts

The grain-oriented electrical steel sheet has a secondary recrystallized texture consisting of (110) [001]orientation which is easily magnetized in the rolling direction and is used as the core materials of a transformer, a power generator, or the like. The grain-oriented electrical steel sheet is industrially produced as follows. Molten steel having an appropriate composition is obtained by a converter process, an electric arc process, or the like. The molten steel is continuously cast to produce a slab. The slab is heated and then hot-rolled to produce a hot-rolled strip. The hot-rolled strip is pickled and occasionally annealed, and subsequently cold-rolled once or twice with an intermediate annealing to produce a cold-rolled strip having a final thickness. The cold-rolled strip is decarburization annealed and annealed at a satisfactorily high temperature, to induce the secondary recrystallization. In these sequential production steps the slab-heating step is important for dissolving the inhibitors, such as MnS, AlN and the like, predominant for the secondary recrystallization, and for preventing an abnormal growth of the continuously cast structure. The magnetic properties of the grain-oriented electrical steel sheet are, therefore, greatly influenced by the slab-heating step.

As is well known, the slabs for producing electrical steel sheets are heated at a temperature of from approximately 1200° to 1400° C.

Japanese Examined Patent Publication No. 56-18654 proposes, for preventing grain-coarsening of the slabs, and accordingly, improving the magnetic properties, to increase the heating rate by not less than 15° C./hr in a high temperature range of slab-heating.

Japanese Unexamined Patent Publication No. 56-152926 proposes, also for preventing grain-coarsening of the slabs, to directly measure the slab-temperature by a thermocouple and to control the slab-heating, thereby attaining a heating temperature of 1300° C. or more at the slab center and surface, and a soaking time of less than 70 minutes.

SUMMARY OF THE INVENTION

The present inventors studied the heating methods of the above proposals so as to further improve the magnetic properties of the steel sheets. The present inventors then discovered that, when the slab itself is used as a resistor in the current-conduction heating, a desirable slab-heating method is most appropriately realized, wherein the slab is rapidly heated while keeping the heat uniformly and also realizes an important soaking method, which should be carried out for the shortest time, at a temperature slightly above the solution temperature of the inhibitors.

The present inventors also discovered that, when the current is conducted under the conditions of an apparent current density (I) of not less than 40 A/cm$^2$ and not more than the 0.5 $P^2+100$ (A/cm$^2$) - wherein P is pressure of the electrodes (kg/cm$^2$) - abnormal grain growth in a slab is prevented and the slab is appropriately heated without an abnormal heating occurring at the parts in contact with the electrodes. The slab-heating as described above provides a starting material for producing a grain-oriented electrical steel sheet which has improved and stabilized magnetic properties with small variation.

The apparent current density herein indicates the conducted current (A) / the cross sectional area of the electrodes (cm$^2$). The pressure of the electrodes herein indicates the pressure of the electrodes (kg) / the cross sectional area of the electrodes (cm$^2$).

DESCRIPTION OF THE PREFERRED EMBODIMENTS

Figure 1:
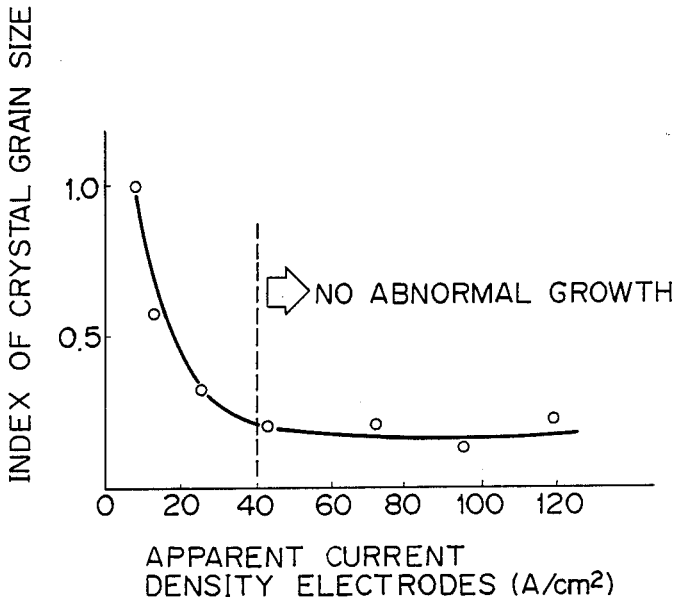
FIG. 1 graphically illustrates the results of an investigation into the influence of the apparent current density of the electrodes upon the index of crystal grain size in the slab heating; and, FIG. 2 graphically illustrates the results of an investigation into the influence of the apparent current density of the electrodes and the pressure of the electrodes upon the fusion bonding between the electrodes and a slab.

Electrical steel-slabs which contained from 0.02 to 0.12% of C, and from 2.0 to 4.0% of Si, as well as the elements for forming the inhibitor such as Mn, S, Al and N, were used as the starting materials. These slabs were heated to 1200°-1350° C. by current conduction while varying the current density to various values, so as to investigate changes in the grain-size of crystals of the slabs. The results are illustrated in FIG. 1 and show the relationships between the apparent current density (I) of the electrodes and the grain size of the crystals. The grain size is shown by an index and defined by the inverse of the number of crystals per 25 cm square of the slabs, and the so-obtained inverse number is converted to 1 at the apparent current density (I) of 10 A/cm$^2$. As is apparent from FIG. 1, the grain size of the crystals becomes virtually constant at the apparent current density (I) of 40 A/cm$^2$ or higher. The grain size is an appropriate value and abnormal grain growth is not recognized.

Figure 2:
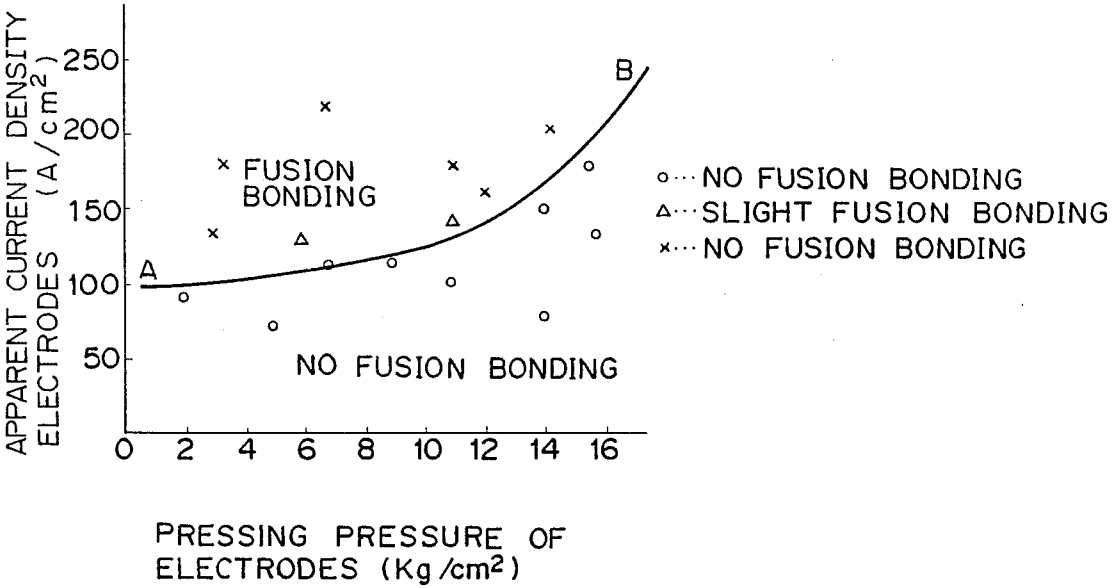

The occurrence of fusion-bonding between the electrodes and a slab was investigated using the same test materials as the test for grain size while varying the pressure of the electrodes against a slab. The results are shown in FIG. 2. As is apparent from FIG. 2, on or below the curve AB, i.e., the apparent current density equal to or greater than $0.5P^2+100$ (A/cm$^2$), fusion bonding did not occur. In addition, on or below the curve AB, an abnormal temperature rise did not occur at the contact part between the electrodes and a slab. This non-occurrence of fusion bonding abnormal temperature rise were little influenced by the composition and size of the slab.

By heating a slab to a temperature of from 1250° to 1400° C., under the conditions of the apparent current density of not less than 40 (A/cm$^2$) and not more than $0.5P^2+100$ (A/cm$^2$), the inhibitors of a slab can be completely dissolved, with the result that a grain-oriented electrical steel sheet having improved magnetic properties can be produced. The temperature at which the current conduction heating through a slab used as a resistor according to a feature of the present invention is carried out, is not limited and may be room temperature or a temperature of from 900° to 1100° C. Such a temperature is attained by a hot slab directly after the continuous casting or by a conventional heating furnace.

Figure 3:
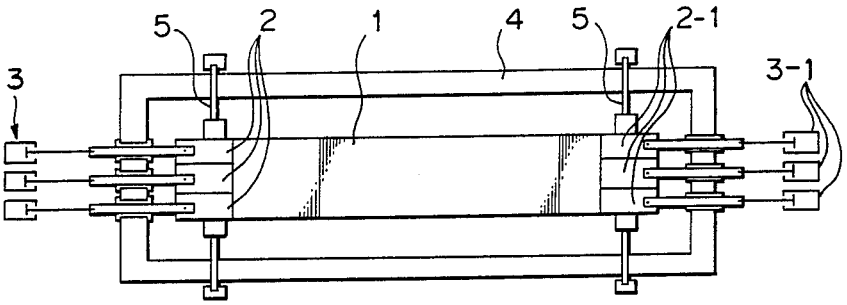
FIG. 3 is a top view of a system for current-conductive heating of a slab according to the present invention.
Figure 4:
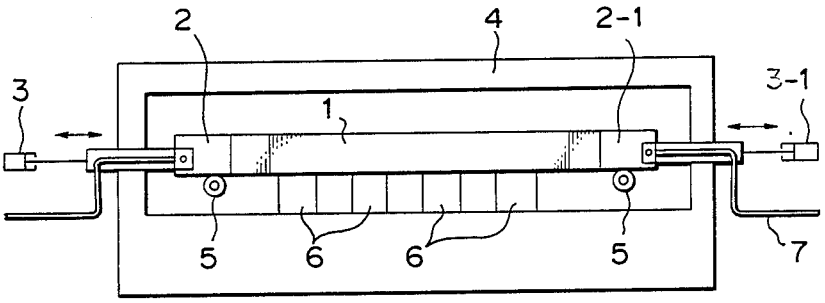
FIG. 4 is an end view of a system for current-conductive heating of a slab according to the present invention.

A method for heating a slab is now described with reference to FIGS. 3 and 4, in which the slab is shown facing the short side.

The electrodes 2, 2-1 are pressed against and brought into contact with both longitudinal sides of a slab 1, and both longitudinal sides of the slab 1 are covered by the electrodes 2, 2-1. The electrodes 2 and 2-1 are positioned opposite to one another, thereby enabling a uniform heating of the entire slab. The current is conducted between the opposed electrodes 2, 2-1 via the slab 1, i.e., the slab 1 is a resistor.

The electrodes 2, 2-1 are connected to a retractable device, such as hydraulic cylinders 3, 3-1, which bring the electrodes 2,2-1 into contact with or away from the slab 1. Reference numeral 4 denotes a wall of a heating furnace, 5 denotes a device supporting the electrodes 2, 2-1, 6 denotes a skid, and 7 denotes a cable.

The electrical steel slab, to which the current conduction heating according to the feature of the present invention is carried out, has the following composition.

When the carbon content is less than 0.02% by weight, a failure of the secondary recrystallization occurs. Conversely, a carbon content of more than 0.12% is disadvantageous to the decarburization and the magnetic properties. Excellent magnetic properties are not obtained if the Si content is less than 2.0%. On the other hand, when the Si content exceeds 4.0%, significant embrittlement occurs and the cold-rollability is degraded. In addition to C, and Si, appropriate elements, such as Mn, S, Se, Al, N, Cu, and the like, for forming the inhibitors, MnS, AlN, MnSe, CuS and the like, are contained in the slab. The contents of these elements are not specified, but representative contents are 0.02 to 0.20% for Mn, 0.005 to 0.05% for S, 0.005 to 0.05% for Se, 0.04% or less for Al, 0.015% or less for N, and 0.5% or less for Cu. Also, Sn, Mo, Sb, Bi, Ni, and/or Cr may be contained in the slab.

The production steps after the slab-heating are not specifically limited but may be known steps. That is, the heated slab is hot-rolled, annealed if necessary, cold-rolled once or twice or more with an intermediate annealing between the cold-rolling steps, so as to obtain the final thickness, decarburized, an annealing separator mainly composed of MgO applied, and finishing annealed at a high temperature.

EXAMPLE 1

Samples were cut from an electrical steel-slab containing 0.045% of C, 3.20% of Si, 0.060% of Mn, and 0.027% of S. One sample was then gas-heated to 1200° C. and then heated to 1350° C. at an apparent current density of 75 A/cm$^2$, followed by holding at 30 minutes. The sample was then hot-rolled to produce a 2.3 mm thick hot-rolled strip. The sample treated as above and described below corresponding to the inventive material A.

Another sample was heated in a conventional heating furnace for hot-rolling and was hot-rolled to produce a 2.3 mm hot-rolled strip. This sample treated as above and described below corresponds to the comparative material B.

The hot-rolled strips corresponding to the inventive material A and the comparative material B were pickled and then cold-rolled to an intermediate thickness of 0.7 mm, intermediate annealed at 950° C. for 1 minute, and cold-rolled to obtain a final thickness of 0.30 mm. Then the decarbuization annealing and high temperature finishing annealing were carried out. The magnetic properties of the products are shown in Table 1.

TABLE 1

| | Watt Loss (W17/50) (W/kg) | Magnetic Properties ($B_{10}$) (Tesla) |
|---|---|---|
| Inventive Material A | 1.14–1.20 (Average 1.16) | 1.85–1.87 (Average 1.86) |
| Comparative Material B | 1.18–1.27 (Average 1.22) | 1.83–1.86 (Average 1.85) |

EXAMPLE 2

Samples were cut from an electrical steel-slab containing 0.065% of C, 3.20% of Si, 0.070% of Mn, 0.026% of S, 0.025% of sol. Al, and 0,0080% of N. One sample was then gas-heated to 1200° C. and then heated to 1350° C. at an apparent current density of 75 A/cm$^2$, followed by holding at 40 minutes. The sample was then hot-rolled to produce a 2.3 mm thick hot-rolled strip. The sample treated as above and described below corresponds to the inventive material C.

Another sample was heated in a conventional heating furnace for hot-rolling and was hot-rolled to produce a 2.3 mm hot-rolled strip. This sample treated as above and described below corresponds to the comparative material D.

The hot-rolled strips corresponding to the inventive material C and the comparative material D were annealed at 1100° C. for 5 minutes, pickled, and then cold-rolled to obtain a final thickness of 0.30 mm. Then the decarburization annealing and high temperature finishing annealing were carried out. The magnetic properties of the products are shown in Table 2.

TABLE 2

| | Watt Loss (W17/50) (W/kg) | Magnetic Properties ($B_{10}$) (Tesla) |
|---|---|---|
| Inventive Material C | 0.88–0.92 (Average 0.90) | 1.92–1.94 (Average 1.93) |
| Comparative Material D | 0.98–1.04 (Average 1.00) | 1.91–1.94 (Average 1.92) |

We claim:

1. A method for producing a grain-oriented electrical steel sheet, wherein an electrical steel slab containing from 0.02 to 0.12% of C, and from 2.0 to 4.0% of Si is heated to a temperature of from 1250° to 1400° C., hot-rolled, cold-rolled once or twice or more with an intermediate annealing, decarburization-annealed and finishing annealed, characterized in that said electrical steel slab itself is used as a current conduction resistor and is heated to said temperature of from 1250° to 1400° C. under a condition of an apparent current density (I) of not less than 40 (A/cm$^2$) and not more than $0.5P^2+100$ (A/cm$^2$), surfaces of both longitudinal ends of said slab being placed in contact with electrodes under a pressure P, where P represents the pressure of the electrodes in kg/cm$^2$.

2. A method according to claim 1, wherein current is conducted between longitudinal sides of the slab (1).

3. A method according to claim 2, wherein said current-conduction heating is initiated at a temperature of from 900° to 1100° C.

* * * * *